US006999692B2

(12) United States Patent
Shimura et al.

(10) Patent No.: US 6,999,692 B2
(45) Date of Patent: Feb. 14, 2006

(54) COLOR IMAGE FORMING APPARATUS WITH TEMPERATURE CONTROL

(75) Inventors: Masaru Shimura, Shizuoka (JP); Takehiko Suzuki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 215 days.

(21) Appl. No.: 10/669,444

(22) Filed: Sep. 25, 2003

(65) Prior Publication Data

US 2004/0109702 A1 Jun. 10, 2004

(30) Foreign Application Priority Data

Sep. 26, 2002 (JP) ..... 2002-281251

(51) Int. Cl.
*G03G 15/20* (2006.01)

(52) U.S. Cl. ..... 399/69; 399/43

(58) Field of Classification Search ..... 399/43, 399/45, 69, 321, 330, 68; 219/216
See application file for complete search history.

(56) References Cited

U.S. PATENT DOCUMENTS

| | | | | |
|---|---|---|---|---|
| 4,682,875 A | | 7/1987 | Suzuki | |
| 5,077,581 A | | 12/1991 | Suzuki | |
| 5,408,301 A | * | 4/1995 | Tokishige et al. | 399/69 |
| 5,464,964 A | | 11/1995 | Okuda et al. | 219/497 |
| 5,918,087 A | * | 6/1999 | Kimura et al. | 399/69 |
| 6,148,163 A | * | 11/2000 | Ito | 399/67 |
| 6,321,047 B1 | * | 11/2001 | Takata | 399/69 |
| 6,751,425 B1 | * | 6/2004 | Fujimori et al. | 399/69 |
| 2003/0039481 A1 | | 2/2003 | Suzuki | 399/81 |

FOREIGN PATENT DOCUMENTS

| | | | |
|---|---|---|---|
| JP | 60263173 A | * | 12/1985 |
| JP | 5-165368 A | | 7/1993 |
| JP | 10274870 A | * | 10/1998 |
| JP | 11174902 A | * | 7/1999 |
| JP | 2000356925 A | * | 12/2000 |

OTHER PUBLICATIONS

U.S. Appl. No. 10/667,351, filed Sep. 23, 2003, Seiji Saito, Tatsuya Kobayashi, Masaru Shimura, Koichi Suzuki, Takamitsu Soda, Pending.

* cited by examiner

*Primary Examiner*—Robert Beatty
(74) *Attorney, Agent, or Firm*—Fitzpatrick, Cella, Harper & Scinto

(57) ABSTRACT

A color image forming apparatus having a plural-color image print mode for successively forming images of plural colors, and a single-color image print mode for forming an image of a single color, is capable of forming, in the plural-color image print mode, a frame of single-color image, and thereafter superimposing and forming an image of the next color on the single-color image. The apparatus includes a fixing apparatus for fixing an image on a recording medium on which an image of plural colors or a single color has been formed, and a temperature controlling portion for controlling the temperature of the fixing apparatus so as to become a target temperature. The fixing apparatus has a heating member and a pressure member and transports the recording medium to a nip part constituted by the heating member and the pressure member. The temperature controlling portion, when continuous printing of plural sheets is to be effected, changes over the target temperature of the heating member when a predetermined number of sheets have been printed, and also changes the predetermined number of sheets for which the target temperature should be changed over, during single-color image printing and during plural-color image printing.

10 Claims, 6 Drawing Sheets

COLOR IMAGE FORMING APPARATUS WITH TEMPERATURE CONTROL

BACKGROUND OF THE INVENTION

1. Field of the Invention

This invention relates to a color image forming apparatus such as an electrophotographic type color copying machine or a color laser printer.

2. Description of Related Art

Numerous image forming apparatuses using an intermediate transferring body have heretofore been proposed as color image forming apparatuses making the most of a feature such as the capability of coping with various transferring materials (recording media), and particularly superimposing a plurality of colors one upon another.

FIG. 9 of the accompanying drawings shows an example of a color image forming apparatus using an intermediate transferring belt. In FIG. 9, on the peripheral surface of a photosensitive drum 101 as a first image bearing member, there are disposed charging means 102, various color developing means of 106 (black), 107 (magenta), 108 (cyan) and 109 (yellow), an intermediate transferring belt 110 as a second image bearing member, and a photosensitive drum cleaner 118, and the color developing means 106–109 are adapted to contact with the photosensitive drum 101 by means (not shown) as required. The intermediate transferring belt 110 is passed over a drive roller 115, a secondary transfer opposing roller 116 and a tension roller 117, and is rotatively driven-in the direction of the associated arrow by the drive roller 115.

The photosensitive drum 101 is rotatively driven in the direction of the associated arrow, and is uniformly charged by the charging means 102 to which a bias of the negative polarity is applied from a bias voltage source 103, and a laser beam 105 comprising a modulated signal is applied thereto by exposure means 104 which is information writing means, whereby an electrostatic latent image is formed on the photosensitive drum. Next, a toner which is a developer charged to the same polarity as the above-mentioned charges is supplied onto the photosensitive drum 101 on which the electrostatic latent image has been formed, by the developing means 106–109, respectively, whereby the electrostatic latent image portion is made into a visualized toner image. Thereafter, a voltage opposite in polarity to the toner is applied to a primary transferring roller 111, which is first transferring means, by a primary transferring bias voltage source 112, and the toner image is electrostatically transferred to the intermediate transferring belt 110.

In the case of plural-color image print (full-color print), the above-described step is repeated four times in all (four-path system) by the developing means 106–109 for a plurality of colors to thereby form a color image on the intermediate transferring belt 110. Thereafter, a voltage opposite in polarity to the toners is applied to a secondary transferring roller 113 which is second transferring means by a secondary transferring bias voltage source 114 through a transferring material 120 to thereby collectively transfer the color image onto the transferring material 120 such as paper, and a color image print is obtained as a permanent image by a fixing apparatus 121.

Also, any primary untransferred toners on the photosensitive drum 101 after the primary transferring step are collected by a cleaner 118, and any secondary untransferred toners on the intermediate transferring belt 110 after the secondary transferring step are collected by a cleaner 119. The cleaner 119 is rockable in the direction of the associated arrow, and is controlled so as to be spaced apart from the intermediate transferring belt 110 when each color toner image is being primary-transferred to the intermediate transferring belt 110, and to abut against the intermediate transferring belt 110 after a four-color toner image has been formed on the intermediate transferring belt 110.

Also, in the case of single-color image print (monocolor print or monochrome print mode), a black toner image by the operation of the black developing means 106 is formed on the photosensitive drum 101, and it is primary-transferred to the intermediate transferring belt 110, and then is secondary-transferred onto the transferring material 120 in a secondary transferring part, and a monocolor print is obtained as a permanent image by the fixing apparatus 121.

The fixing apparatus 121 adopts the construction of a film fixing apparatus using as a heating member cylindrical fixing film heated by a ceramic heater or the like provided therein, and the heating member is temperature-controlled on the basis of a temperature detected by a thermistor which is temperature detecting means so that the surface temperature of the fixing film may become a control target temperature by a heater driving circuit. At this time, the control target temperature changes to a plurality of stages in conformity with the number of printed sheets per job (see e.g. Japanese Patent Application Laid-Open No. H5-165368).

However, when the aforedescribed conventional fixing apparatus is used in a color image forming apparatus, there has been the problem that the toner image on the transferring material is offset during plural-color image print. This will hereinafter be described in detail.

The above-noted phenomenon is the phenomenon that when temperature is controlled by the control target temperature during single-color image print, in the case of plural-color image print, the temperature of a pressure roller rises and the toner on the transferring material is excessively melted and some of the toner on the transferring material is offset to the fixing film side.

According to the applicant's studies, it has been found that during plural-color image print, as compared with during single-color image print, the paper transfer interval becomes wide and therefore during continuous print, the temperature of the pressure roller becomes higher than during single-color image print. That is, during plural-color image print, the temperature of the fixing film is substantially the same as that during single-color image print, but the temperature of the pressure roller is high and therefore, the temperature of the entire fixing apparatus becomes high, and the amount of heat applied to the toners on the transferring material increases. Therefore, the toners on the transferring material are melted too much, and when the transferring material passes through a nip part which is the portion of contact between the fixing film and the pressure roller, a part of the too much melted toners is offset onto the fixing film. These offset toners are fixed on the transferring material after the fixing film has made a round, thereby causing a faulty image.

SUMMARY OF THE INVENTION

The present invention has been made in view of such circumstances and has as its object to prevent offset during plural-color image print.

To achieve the above object, a color image forming apparatus according to the present invention is a color image forming apparatus having a plural-color image print mode for successively forming images of plural colors, and a single-color image print mode for forming an image of a single color, and in the plural-color image print mode, using the step of forming a frame of single-color image, and thereafter superimposing and forming an image of the next color on the single-color image, and has:

a fixing apparatus for fixing an image on a recording medium on which the images of plural colors or the image of a single color has been formed; and a temperature control portion for controlling the temperature of the fixing apparatus so as to become a target temperature;

wherein the fixing apparatus has a heating member and a pressure member, and transports the recording medium to a nip part constituted by the heating member and the pressure member, and when the printing of a plurality of sheets is to be continuously effected, the temperature control portion changes over the target temperature of the heating member when a predetermined number of sheets have been printed, and changes the predetermined number of sheets for which the target temperature should be changed over, during single-color image print and during plural-color image print.

Preferably, the color image forming apparatus successively forms images of plural colors on an image bearing member in the plural-color image print mode, and forms an image of a single color on the image bearing member in the single-color image print mode, and has transferring means for transferring the images of plural colors or the image of a single color formed on the image bearing member onto the recording medium.

Preferably, in the plural-color image print mode, the recording medium held by a recording medium supporting member is repetitively transported to an image forming portion to thereby successively form images of plural colors on the same recording medium, and in the single-color image print mode, the recording medium is transported once to thereby form an image of a single color thereon.

Preferably, the color image forming apparatus has a plurality of fixing speeds, and changes the changeover timing of the control target temperature of the heating member during the single-color image print mode and during the plural-color image print mode and in conformity with the fixing speeds.

Preferably, the color image forming apparatus has a plurality of modes between which the number of revolutions of the image bearing member or the recording medium supporting member differs, and changes the changeover timing of the control target temperature of the heating member during the single-color image print mode and during the plural-color image print mode and in conformity with the number of revolutions of the image bearing member or the recording medium supporting member.

Preferably, the heating member has at least a film of a metal or resin, and a heat generating member contacting with the film.

According to the present invention, in the color image forming apparatus, the changeover timing of the control target temperature of the fixing apparatus is changed during the single-color image print and during the plural-color image print, whereby the temperature rise of the pressure member can be suppressed and therefore, it has become possible to prevent the occurrence of the phenomenon that the toner on the transferring material or the recording medium is melted too much and is offset to the heating member.

Also, the changeover timing of the control target temperature is changed in conformity with the fixing speeds, whereby it has become possible to suppress the temperature rise of the pressure member when the paper transporting speeds differs, and prevent the offset phenomenon.

Also, the changeover timing of the control target temperature is changed in conformity with the number of revolutions of the image bearing member or the recording medium supporting member, whereby it has become possible to suppress the temperature rise of the pressure member when the paper transport interval differs, and prevent the offset phenomenon.

DESCRIPTION OF THE PREFERRED EMBODIMENTS (First Embodiment)

An image forming apparatus according to the present invention will hereinafter be described in detail with reference to the drawings.

(1) Color Image Forming Apparatus

Figure 1:
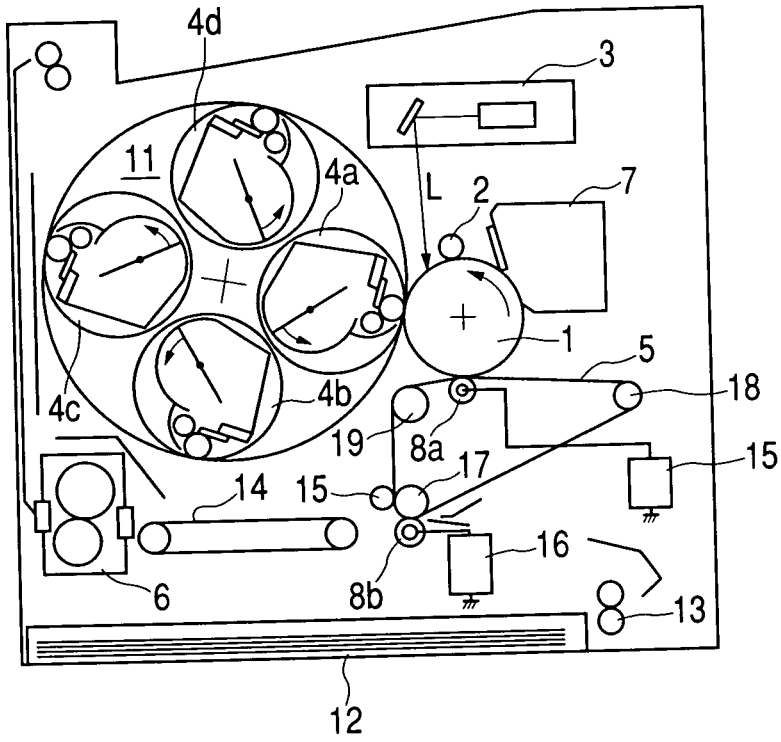
FIG. 1 shows an image forming apparatus according to a first embodiment of the present invention.

FIG. 1 schematically shows the construction of a color image forming apparatus according to the present invention. A photosensitive drum 1, which is a first image bearing member, is an OPC photosensitive member of negative polarity, has a diameter of 47 mm, is driven in the direction of the associated arrow by driving means (not shown) and is uniformly charged to −650V by a charging roller 2, which is charging means.

In the case of plural-color image print (full-color print), a laser beam L conforming to a yellow image pattern is then applied from an exposure apparatus 3 to the photosensitive drum 1, and an electrostatic latent image is formed on the photosensitive drum 1. Further, as the photosensitive drum 1 is rotated in the direction of the associated arrow, among color developing means 4*a* (yellow), 4*b* (magenta), 4*c* (cyan) and 4*d* (black) supported by a rotary device 11 which is a rotary supporting body, the developing means 4*a* containing a yellow toner therein is rotated so as to be opposed to the photosensitive drum 1, and the electrostatic latent image is visualized by the selected developing means 4*a*.

An intermediate transferring body (intermediate transferring belt) 5, which is a second image bearing member, is passed over an opposing roller 17, which is an opposing member, providing an opposing portion to second transferring means, a drive roller 18, which is a driving member for the intermediate transferring belt 5, and a tension roller 19, which is a stretching member for the intermediate transferring belt 5, and is rotated in the direction of the associated arrow at a speed of 101% relative to the photosensitive drum 1 by the drive roller 18.

A yellow toner image formed and borne on the photosensitive drum 1 is primary-transferred to the outer peripheral surface of the intermediate transferring belt 5 by a primary transferring bias applied from a primary transferring bias voltage source 15 to a primary transferring roller 8*a* which is first transferring means.

The steps of forming a toner image on the photosensitive drum 1, and primary-transferring the toner image to the intermediate transferring belt 5, as described above, are successively executed for magenta, cyan and black, whereby toner images of plural colors are formed on the intermediate transferring belt 5. Next, at predetermined timing, a transferring material as a recording medium is fed from a transferring material cassette 12 by a pickup roller 13. At the same time, a secondary transferring bias is applied from a secondary transferring bias voltage source 16 to a secondary transferring roller 8*b* which is second transferring means, and the toner images are collectively secondary-transferred from the intermediate transferring belt 5 to the transferring material.

Further, the transferring material is transported to a fixing apparatus 6 by a transporting belt 14, and the toner images thereon are melted and fixed, whereby a color image print is obtained.

Also, any untransferred toners on the intermediate transferring belt 5 have charges imparted thereto by an intermediate transfer cleaning roller 15 and are inversely transferred onto the photosensitive drum 1 during the next primary transfer. Here, by the intermediate transfer cleaning roller 15 being used as cleaning means for the intermediate transferring belt 5, stress applied from the blade cleaning means shown in the example of the prior art to the intermediate transfer belt 5 becomes small, and it becomes possible to prevent any damage or injury to the intermediate transferring belt 5. On the other hand, any untransferred toners on the photosensitive drum 1 are cleared away by blade cleaning means 7.

Also, in the case of single-color image print (monocolor print), a black toner image by the operation of the black developing means 4*d* is formed on the photosensitive drum 1, and it is primary-transferred to the intermediate transferring belt 5, and then is secondary-transferred onto a transferring material at secondary transfer, and the toner image is melted and fixed by the fixing apparatus 6, whereby a monocolor print is obtained.

Inside or outside the housing of the image forming apparatus, there is provided an image data processing apparatus (not shown, and hereinafter referred to as the formatter) for converting (evolving) print data described in printer language from a host computer into bit data, and the laser beam L is modulated on the basis of the bit data outputted from the formatter.

(2) Operating Steps of the Image Forming Apparatus

Figure 10:
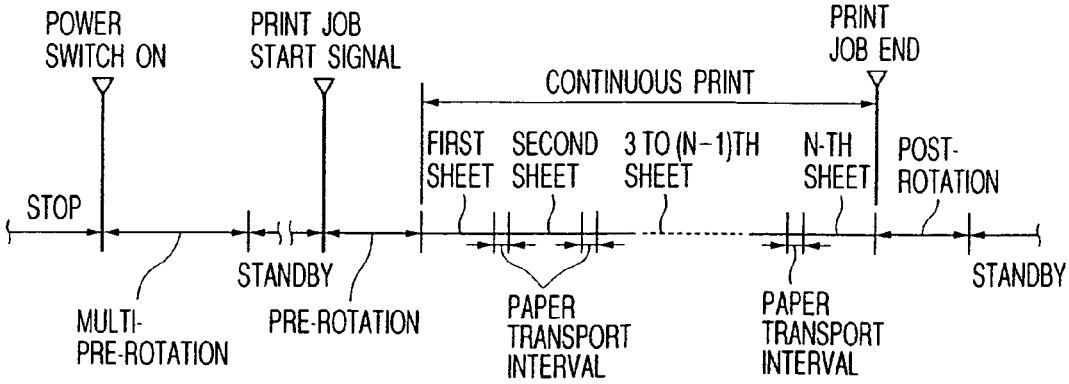
FIG. 10 shows the operating steps of the image forming apparatus.

FIG. 10 shows the operating steps of the above-described image forming apparatus.

1) Multi-Pre-Rotation (Pre-Multiple Rotation) Step

This is the starting (actuating) operation period (warming period) of the image forming apparatus. By the closing of the main power supply switch of the image forming apparatus, the main motor (not shown) of the image forming apparatus is actuated to thereby execute the preparatory operation of a required process instrument.

2) Standby

The driving of the main motor is stopped after the termination of the predetermined starting operation period, and the image forming apparatus is maintained in a standby state until a print job start signal is inputted from the formatter.

3) Pre-Rotation Step

This is a period during which the main motor is redriven on the basis of the inputting of the print job start signal from the formatter to thereby execute the print job pre-operation of the required process instrument.

More actually, the order is thus: a) the image forming apparatus receives the print job start signal, b) an image is evolved by the formatter (the evolving time is changed by the data amount of the image and the processing speed of the formatter), and c) the pre-rotation step is started.

If during the pre-multiple rotation step of the above item 1), the print job start signal is inputted, shift is subsequently made to the pre-rotation step after the termination of the pre-multiple rotation step, without shift being made to the standby state of the above item 2).

4) Execution of Print Job

When the predetermined pre-rotation step is terminated, the above-described image forming process is subsequently executed, and a recording material on which an image has been formed is outputted.

In the case of a continuous print job, the aforedescribed image forming process is repeated and a predetermined number of recording materials on which images have been formed are successively outputted.

5) Paper Transport Interval Step

In the case of the continuous print job, this is the interval step between the trailing edge of a recording material P and the leading edge of the next recording material P, and is a non-paper passing state period in the transferring portion and the fixing apparatus.

6) Post-Rotation Step

This is a period during which in the case of a print job for only a sheet, after the recording material on which an image has been formed is outputted (the termination of the print job), or in the case of a continuous print job, after the last recording material on which an image has been formed in the continuous print job is outputted (the termination of the print job), the main motor is still continuously driven to thereby execute the print job post-operation of the required process instrument.

7) Standby

After the termination of the predetermined post-rotation step, the driving of the main motor is stopped, and the image forming apparatus is maintained in the standby state until the next print job start signal is inputted.

(3) Fixing Apparatus 6

Figure 2:
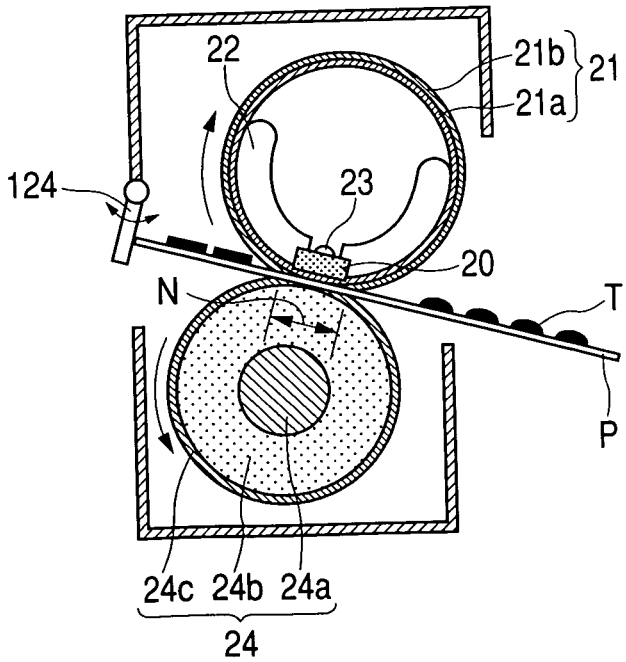
FIG. 2 is a cross-sectional view of a fixing apparatus in the first embodiment of the present invention.

The fixing apparatus 6 of the color image forming apparatus used here is shown in FIG. 2. The fixing apparatus 6 adopts the construction of a film fixing apparatus using as a heating member cylindrical film heated by a ceramic heater or the like provided therein.

The heating member is comprised of fixing film 21 comprising a cylindrical endless film, a film guide 22 for guiding the fixing film 21, a ceramic heater 20, which is a heat generating body, and a thermistor 23 which is temperature detecting means provided on the non-contact surface of the ceramic heater 20 with respect to the fixing film 21, and is pressed against a pressure roller 24 by pressing means (not shown).

Also, the fixing film 21 is constructed so as to form a mold releasing layer 21*b* of polytetrafluoroethylene (PTFE), tetrafluoroethylene-perfluoroalkylvinylether copolymer (PFA) or the like having a high mold releasing property on heat-resistant film 21*a* of polyimide resin (PI), metal film or the like.

The pressure roller 24 comprises a mandrel 24*a* of aluminum, iron or the like, an elastic layer 24*b* of silicone rubber or the like provided thereon, and a mold releasing layer 24*c* of fluorine resin such as PTFE or PFA having a high mold releasing property further provided thereon.

The pressure roller 24 is rotatively driven by driving means (not shown) and a rotating force acts on the fixing film 21 due to the frictional force between the outer peripheral surfaces of the pressure roller 24 and the fixing film 21 by the rotative driving of the pressure roller 24, and the fixing film 21 is driven to rotate at a peripheral speed substantially corresponding to the rotational peripheral speed of the pressure roller 24 while sliding with the inner surface thereof being in close contact with the ceramic heater 20 at a nip part N.

The transferring material P bearing the toner image T thereon is guided to the fixing apparatus 6, is directed to the nip part N formed by the contact portion between the fixing film 21 and the pressure roller 24, and is heated and pressurized there, whereby the toner image T is fixed, and the transferring material P is discharged out of the fixing apparatus. Also, the transferring material P, when it is discharged out of the fixing apparatus 6, brings down a sheet discharge sensor 124 and detects the presence or absence of the passage of the transferring material P through the fixing apparatus 6.

(4) Control Target Temperature Changeover Control of the Heating Member

The present embodiment is characterized in that the control target temperature of the heating member is changed over in conformity with the number of printed sheets, and the changeover timing of the control target temperature differs between during single-color image print and during plural-color image print.

Description will hereinafter be made in detail about a case where continuous print is effected at the cold start whereat the temperature of the pressure roller 24 is room temperature.

Here, the color image forming apparatus used in the present embodiment is such that a) the process speed is 120 mm/sec. and b) the throughput is during single-color image print: 16 ppm during plural-color image print: 4 ppm.

Figure 3:
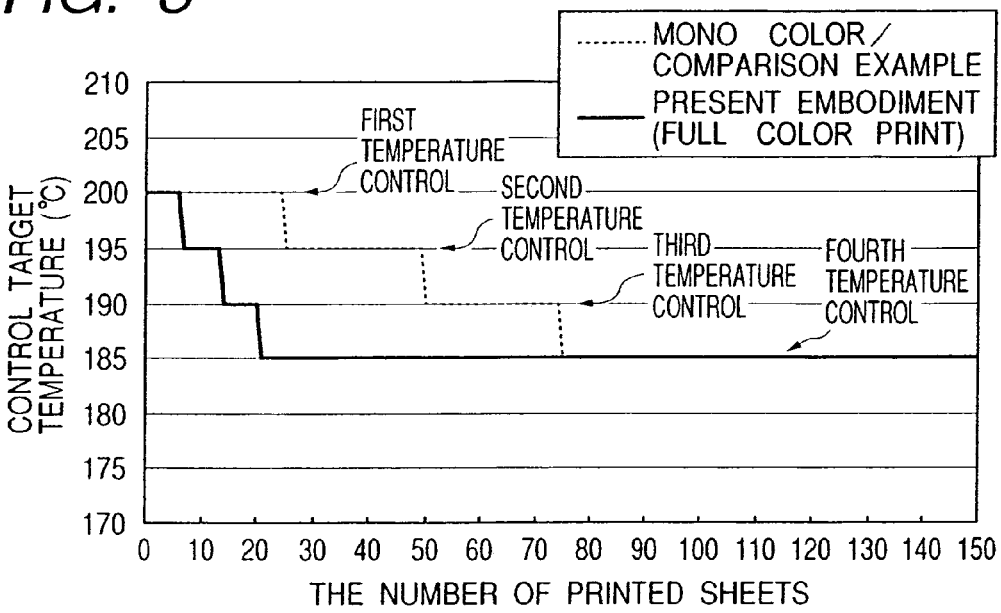
FIG. 3 is a graph showing temperature control in the first embodiment of the present invention.
Figure 12:
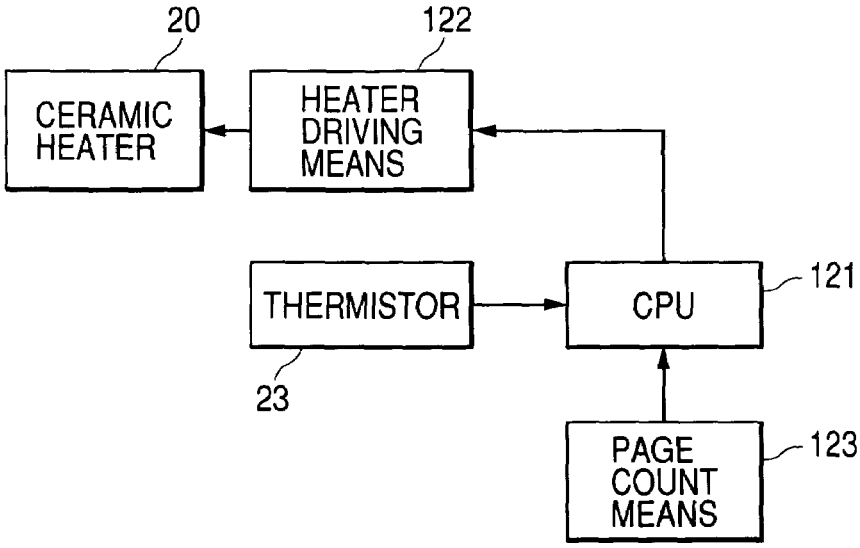
FIG. 12 is a block diagram of the image forming apparatus according to each embodiment of the present invention.

Description will hereinafter be made in conformity with this color image forming apparatus. As shown in FIG. 12, in the present embodiment, the fixing apparatus 6 is such that the temperature detected by the thermistor 23 is inputted to a CPU 121, and the electrical energization time of the ceramic heater 20 is changed by heater driving means 122 so that the temperature may become a preset target temperature to thereby effect temperature control. Also, the number of continuously printed sheets detected by page count means 123 is inputted to the CPU 121, and in conformity with the number of continuously printed sheets, as shown in FIG. 3, four stages of changeover of the control target temperature are carried out during single-color image/plural-color image print.

In the present embodiment, the page count means 123 is a sheet discharge sensor 124 disposed in the sheet discharging portion of the fixing apparatus 6, and inputs to the CPU 121 a signal produced when the transferring material P passes the sheet discharge sensor 124 portion, and the signal is integrated in the CPU 121 to thereby effect page count.

Specifically, during single-color image print (monocolor print), setting is effected such that first temperature control (during 0 to 24 sheets of print) is set at 200° C., second temperature control (25 to 49 sheets) is set at 195° C., third temperature control (50 to 74 sheets) is set at 190° C., fourth temperature control (75th and subsequent sheets) is set at 185° C.

On the other hand, during plural-color image print (full-color print), as compared with during the single-color image print, toner images of four colors are formed on the intermediate transferring belt 5, and thereafter are collectively transferred in the secondary transferring portion and thus, the throughput becomes 0.25 time as great and the paper transport interval widens to about four times.

Accordingly, during the plural-color image print, setting is effected such that first temperature control (during 0 to 6 sheets of print) is set at 200° C., second temperature control (7 to 13 sheets) is set at 195° C., third temperature control (14 to 20 sheets) is set at 190° C., fourth temperature control (21st and subsequent sheets) is set at 185° C.

Also, as a comparative example, use has been made of a construction in which during plural-color image print, as in the above-described temperature control during the single-color image print, setting is effected such that first temperature control (during 0 to 24 sheets of print) is set at 200° C., second temperature control (25 to 49 sheets) is set at 195° C., third temperature control (50 to 74 sheets) is set at 190° C., fourth temperature control (75th and subsequent sheets) is set at 185° C.

About the above-described three kinds of constructions, the temperatures of the pressure roller 24 and the occurrence situation of the offset have been evaluated.

Figure 4:
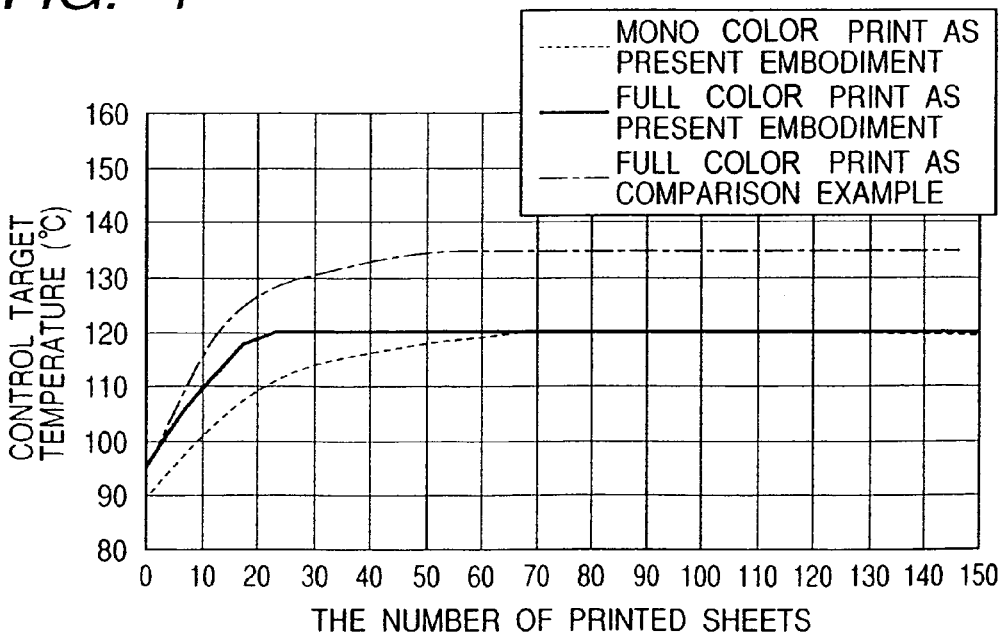
FIG. 4 is a graph showing the temperature of a pressure roller in the first embodiment of the present invention.

The temperatures of the pressure roller 24 in the respective cases are shown in FIG. 4. According to FIG. 4, during the single-color image print, the temperature of the pressure roller 24 rises from room temperature (25° C. in the present embodiment) and in terms of the number of printed sheets, the control target temperature is changed over from 200° C. to 185° C. through 195° C. and 190° C. and therefore, the average temperature of the pressure roller 24 changes so as to rise from room temperature (25° C. in the present embodiment) from the pre-rotation for making preparations for the image forming operation till the image forming operation for the first sheet, and become 90° C. when the first sheet of transferring material P comes into the fixing nip N, and be saturated at 120° C. during 80 sheets of print.

On the other hand, in the present embodiment, during plural-color image print, the image forming time becomes long as compared with the case of single-color image print and therefore, the temperature of the pressure roller 24 rises, and becomes 95° C. when the first sheet of transferring material P comes into the fixing nip N. Also, during plural-color image print, the paper transport interval during continuous print widens as compared with the case of single-color image print and therefore, the temperature rise of the pressure roller 24 is rapid, and the average temperature of the pressure roller 24 changes so as to be saturated at 120° C. during 20 sheets of print.

In the comparative example wherein control target temperature changeover timing similar to that during single-color image print was carried out during plural-color image print, the paper transport interval widens and therefore, the paper P, which is the transferring material, does not take away the heat of the pressure roller 24 and the heating of the pressure roller 24 is expedited. Accordingly, as shown in FIG. 4, the average temperature of the pressure roller 24 in the comparative example changes such that the temperature control and time until the first sheet of transferring material P comes into the fixing nip N are similar to those in the present embodiment and therefore, the temperature of the pressure roller 24 when the first sheet of transferring material P comes into the fixing nip N is similar to 95° C., but the changeover timing of temperature control differs from that in the present embodiment and therefore, the saturation temperature of the pressure roller 24 rises as compared with that in the present embodiment, and becomes 135° C.

In the comparative example, the sum of the temperature of the fixing film 21 and the temperature of the pressure roller 24 reaches a maximum of about 330° C. Therefore, the amount of heat applied to the toner on the transferring material increases and the toner T on the transferring material P is melted too much, and some of the too much melted toner T is offset onto the fixing film 21 and is refixed on the transferring material after the fixing film 21 has made a round, thereby causing a faulty image. This phenomenon occurred particularly remarkably on the 15th sheet to the 24th sheet during continuous print. The reason for this is that the toner T on the transferring material P directly contacts with the fixing film 21 and therefore, the above-described offset becomes more disadvantageous when the temperature of the fixing film 21 is high. Accordingly, in the first temperature control wherein the temperature of the fixing film 21 is high, the above-described offset phenomenon occurs remarkably for the 15th to 24th sheets for which the temperature of the pressure roller 24 becomes high.

On the other hand, in the construction of the present embodiment, during plural-color image print, as during single-color image print, the average temperature of the pressure roller 24 changes with 120° C. as the upper limit and therefore, the sum of the temperature of the fixing film 21 and the temperature of the pressure roller 24 becomes a maximum of about 310° C., and this is lower by about 20° C. than in the comparative example. Therefore, good images could be obtained without the toner T on the transferring material P being melted too much and without the above-described offset phenomenon being caused.

While in the present embodiment, description has been made of a case where the continuous print from the state of cold start (the temperature of the pressure roller 24 being room temperature), this is not particularly restrictive, but during intermittent print, an effect similar to that in the present embodiment will be obtained even if the following controller method is carried out. For example, during the intermittent print, the print interval is measured by a timer or the like for measuring the interval between prints, and when the print interval is a predetermined value or less, the number of intermittently printed sheets is counted like the count of the number of sheets during continuous print, and temperature control similar to that during the continuous print is effected, and when the print interval is greater than the predetermined value, the temperature of the ceramic heater 20 is detected by the thermistor 23, and in conformity with the result of the detection, the changeover timing and changeover frequency of the control target temperature are changed, whereby it becomes possible to suppress the temperature rise of the pressure roller 24 and during the intermittent print as well, an effect similar to that of the present embodiment is obtained.

Thus, the temperature rise of the pressure roller 24 during plural-color image print can be suppressed and therefore, it has become possible to prevent the occurrence of the offset phenomenon attributable to the toner T on the transferring material P being melted too much.

(Second Embodiment)

A color image forming apparatus used in this embodiment is similar to the first embodiment in the flow from construction and image forming to transfer and fixing and therefore, the flow need not be described.

In the present embodiment, it is the feature of the color image forming apparatus having a plurality of fixing speeds that the changeover timing of temperature control is changed in conformity with the fixing speeds.

The color image forming apparatus according to the present embodiment has a plurality of fixing speeds. Specifically, it has a 1/1 speed mode for plain paper, and a 1/2 speed mode in which the paper transporting speed is slowed down to secure a fixing property, the degree of luster, a transmitting property, etc., for OHT, glossy film, thick paper, etc. Specifically, in the 1/2 speed mode, the procedure up to the step of successively primary-transferring toners onto the intermediate transferring belt 5 is the same as in the ordinary 1/1 speed mode, but the toners of plural colors successively layered on the intermediate transferring belt 5 are collectively transferred to the transferring material P such as paper. From the secondary transferring step, the paper transporting speed is the ordinary 1/2 speed. Accordingly, at the fixing step as well, the transferring material P comes in at a transporting speed of the ordinary 1/2 speed, and the fixing step is effected.

Here, in the color image forming apparatus used in the present embodiment, a) the process speed is 120 mm/sec., and b) the throughput is during single-color image print: 16 ppm, during plural-color image 1/1 speed print: 4 ppm, during plural-color image 1/2 speed print: 2.5 pmm.

Figure 5:
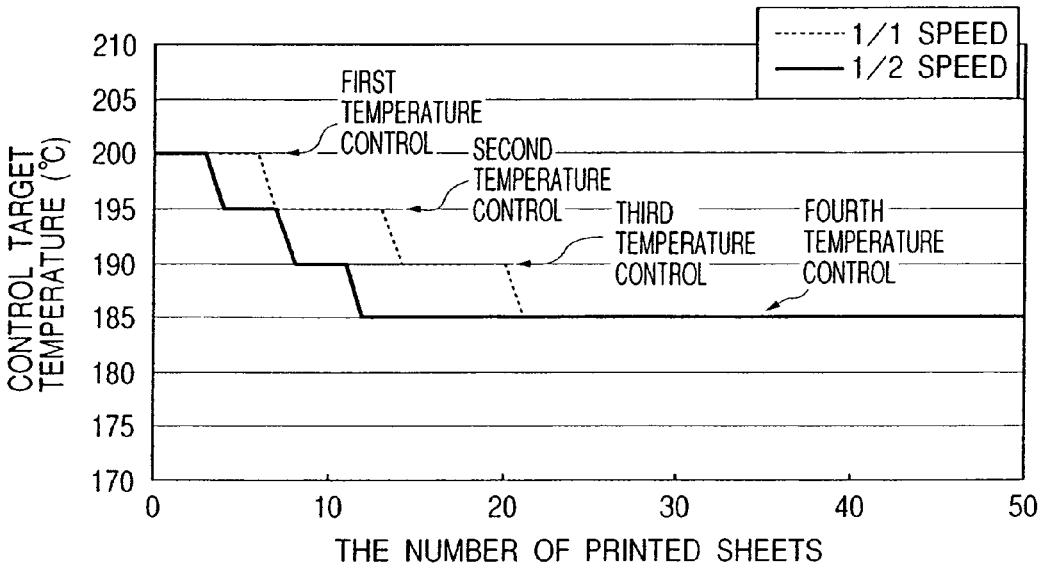
FIG. 5 is a graph showing temperature control in a second embodiment of the present invention.

Description will hereinafter be made in conformity with this color image forming apparatus. In this case, in the present embodiment, as shown in FIG. 5, four stages of changeover of the control target temperature are carried out in conformity with the number of printed sheets at the 1/2 speed time during plural-color image print.

Specifically, during the 1/1 speed plural-color image print, setting is effected such that first temperature control (during 0 to 6 sheets of print) is set at 200° C., second temperature control (7 to 13 sheets) is set at 195° C., third temperature control (14 to 20 sheets) is set at 190° C., fourth temperature control (21st and subsequent sheets) is set at 185° C.

On the other hand, during the 1/2 speed plural-color image print, as compared with the 1/1 speed, the paper transporting speed is 1/2, but till the primary transferring step, image forming is effected at a speed similar to the 1/1 speed and therefore, the throughput becomes about 0.6 time as great, and the paper transport interval widens to about 1.5 times. Accordingly, during the 1/2 speed plural-color image print, setting is effected such that first temperature control (during 0 to 4 sheets of print) is set at 200° C., second temperature control (5 to 9 sheets) is set at 195° C., third temperature control (10 to 14 sheets) is set at 190° C., fourth temperature control (18th and subsequent sheets) is set at 185° C.

About the above-described construction, the temperature of the pressure roller 24 and the occurrence situation of offset have been evaluated.

Figure 6:
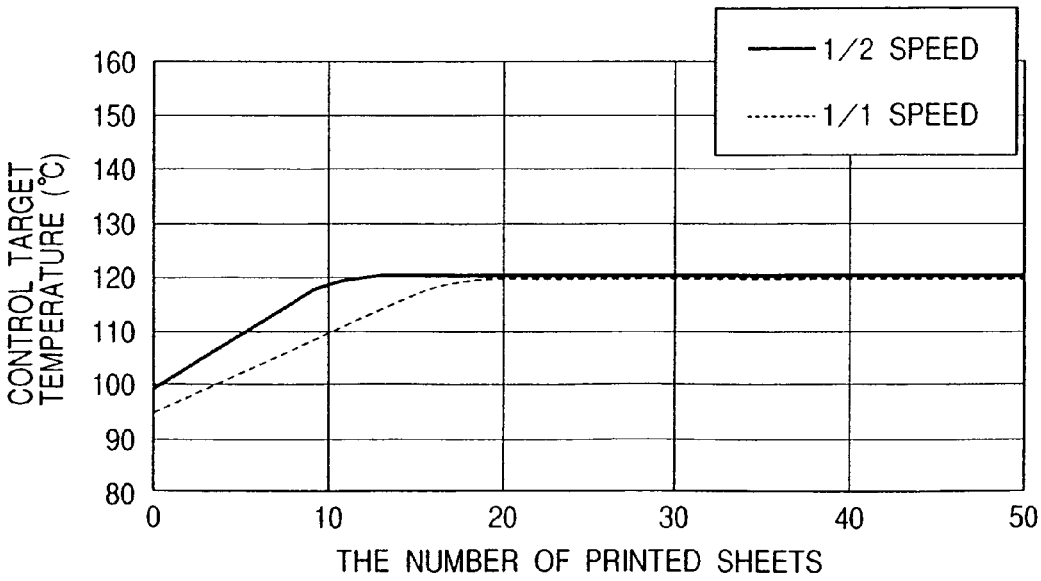
FIG. 6 is a graph showing the temperature of a pressure roller in the second embodiment of the present invention.

The temperatures of the pressure roller 24 at this time are shown in FIG. 6. At the 1/1 speed time, as in the first embodiment, the temperature of the pressure roller 24 is saturated at 120° C. for the 20th and subsequent sheets.

On the other hand, in the present embodiment, at the 1/2 speed time, the average temperature of the pressure roller 24 changes so as to be saturated at 120° C. during 12 sheets of print. The reason for this is that at the 1/2 speed time, the paper transport interval widens as compared with the 1/1 speed time and therefore, the temperature rise of the pressure roller 24 is rapid, but in the present embodiment, the changeover timing of the control target temperature is quickened as compared with the 1/1 speed time and therefore, the saturation temperature of the average temperature of the pressure roller 24 does not change.

Also, in the construction of the present embodiment, during the 1/2 speed plural-color image print, as during the 1/1 speed plural-color image print, the average temperature of the pressure roller 24 changes with 120° C. as the upper limit and therefore, good images could be obtained without the toner T on the transferring material P being melted too much and without the above-described offset phenomenon being caused.

Thus, the temperature rise of the pressure roller 24 during the 1/2 speed print can be suppressed and therefore, it has become possible to prevent the occurrence of the offset phenomenon attributable to the toner T on the transferring material P being melted too much.

(Third Embodiment)

A color image forming apparatus used in this embodiment is similar to the first embodiment in the flow from construction and image forming to transferring and fixing and therefore, the flow need not be described.

In the present embodiment, it is the feature of the color image forming apparatus having a plurality of modes differing in the number of revolutions of the intermediate transferring belt 5 from each other that the changeover timing of the control target temperature is changed in conformity with the number of revolutions of the intermediate transferring belt 5.

The color image forming apparatus according to the present embodiment has a plurality of paper transport intervals. Specifically, during the normal mode, the intermediate transferring belt 5 makes four revolutions to thereby successively primary-transfer the toners of four colors onto the intermediate transferring belt 5, and the toner images borne on the intermediate transferring belt 5 are collectively transferred onto the transferring material P such as paper. However, when secondary transferring efficiency has been aggravated, there is the possibility that any secondary-untransferred toners on the intermediate transferring belt 5 cannot be sufficiently cleared away. Therefore, a five-revolution mode in which the cleaning step for the intermediate transferring belt 5 is added by one round exists as a high level cleaning mode. In the five-revolution mode, the intermediate transferring belt 5 is revolved one round extra and therefore, the paper transport interval widens by an amount corresponding to one revolution of the intermediate transferring belt 5. Here, in the color image forming apparatus used in the present embodiment, a) the process speed is 120 mm/sec., and b) the throughput is during single-color image print: 16 ppm, during the normal mode of plural-color image print: 4 ppm, during the high level cleaning mode of plural-color image print: 3.2 ppm.

Figure 7:
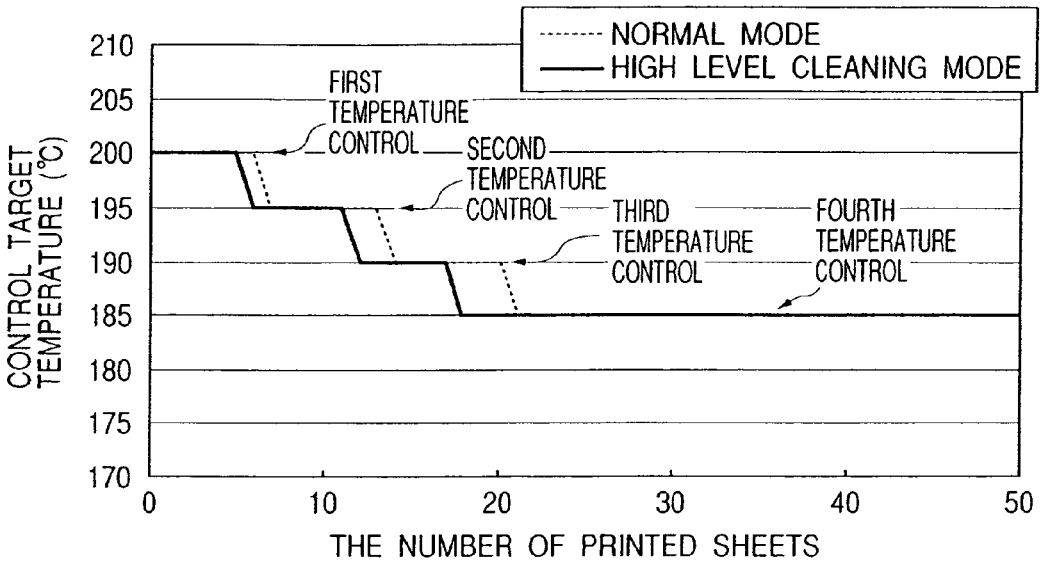
FIG. 7 is a graph showing temperature control in a third embodiment of the present invention.

Description will hereinafter be made in conformity with this color image forming apparatus. In this case, in the present embodiment, in conformity with the number of printed sheets, as shown in FIG. 7, four stages of changeover of control target temperature are carried out in the high level cleaning mode during plural-color image print.

Specifically, during the normal mode, as in the first embodiment, setting is effected such that first temperature control (during 0 to 6 sheets of print) is set at 200° C., second temperature control (7 to 13 sheets) is set at 195° C., third temperature control (14 to 20 sheets) is set at 190° C., fourth temperature control (21st and subsequent sheets) is set at 185° C.

On the other hand, during the high level cleaning mode, as compared with during the normal mode, the paper transporting speed does not change, yet the intermediate transferring belt 5 is revolved one revolution extra and therefore, the throughput becomes about 0.8 time as great, and the paper transport interval widens to about 1.25 time.

Accordingly, during the high level cleaning mode, setting is effected such that first temperature control (during 0 to 5 sheets of print) is set at 200° C., second temperature control (6 to 11 sheets) is set at 195° C., third temperature control (12 to 17 sheets) is set at 190° C., fourth temperature control (18th and subsequent sheets) is set at 185° C.

About the above-described construction, the temperature of the pressure roller 24 and the occurrence situation of offset have been evaluated.

Figure 8:
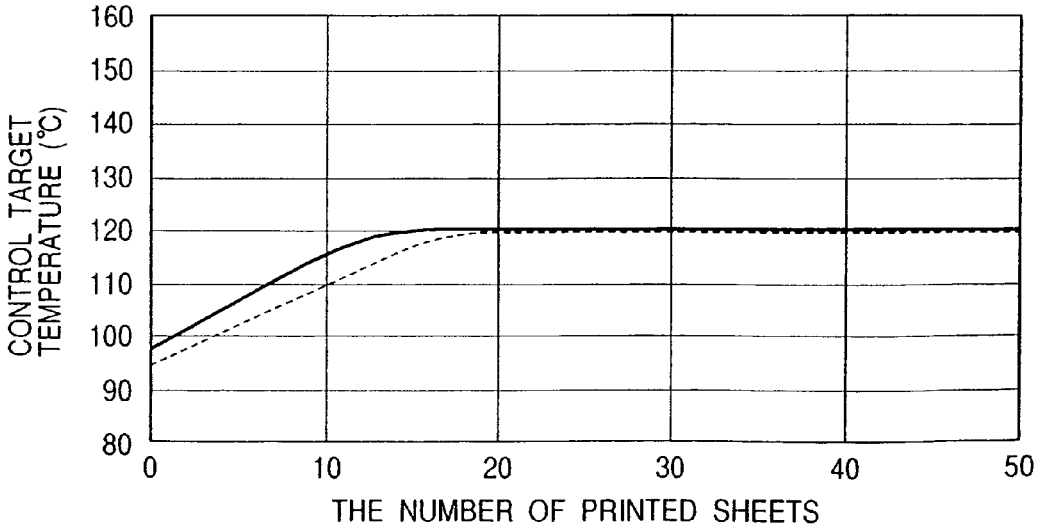
FIG. 8 is a graph showing the temperature of a pressure roller in the third embodiment of the present invention.
Figure 9:
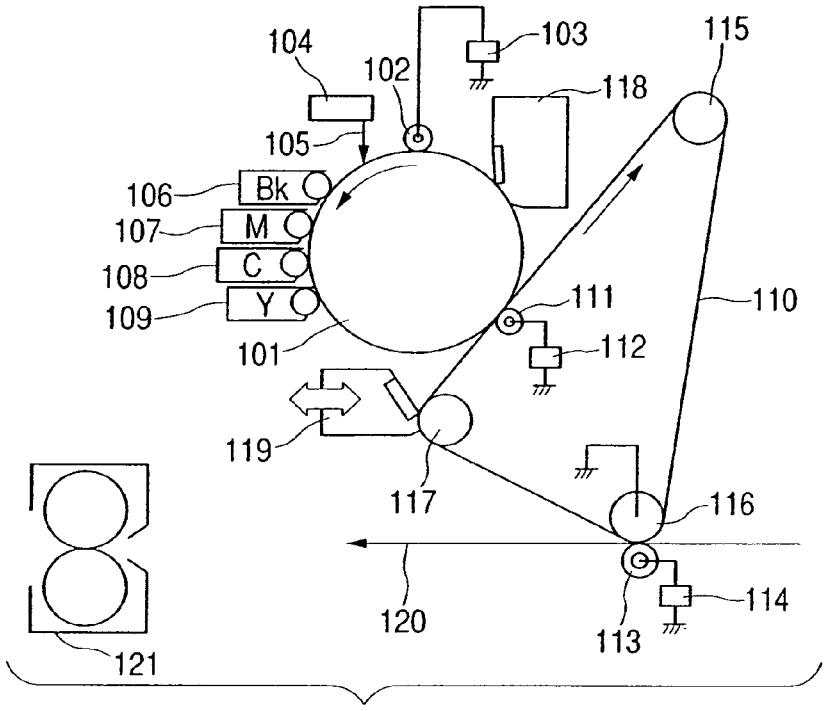
FIG. 9 Prior Art
FIG. 9 is an illustration of an example of a conventional image forming apparatus.

The temperature of the pressure roller 24 at this time is shown in FIG. 8. During the normal mode, as in the first embodiment, the temperature of the pressure roller 24 is saturated at 120° C. for the 20th and subsequent sheets.

On the other hand, in the present embodiment, during the high level cleaning mode, the average temperature of the pressure roller 24 changes so as to be saturated at 120° C. during 16 sheets of print.

The reason for this is that during the high level cleaning mode, the paper transport interval widens as compared with during the normal mode and therefore, the temperature rise of the pressure roller 24 is rapid, but in the present embodiment, as compared with during the normal mode, the changeover timing of the control target temperature is quickened and therefore, the saturation temperature of the average temperature of the pressure roller 24 does not change.

Also, in the construction of the present embodiment, during the high level cleaning mode, as during the normal mode, the average temperature of the pressure roller 24 changes with 120° C. as the upper limit and therefore, good images could be obtained without the toner T on the transferring material P being melted too much and without the above-described offset phenomenon being caused.

While herein, the high level cleaning mode has been taken up as an example of a mode in which the number of revolutions of the intermediate transferring belt 5 changes, this is not particularly restrictive, but of course, if in the mode wherein the number of revolutions of the intermediate transferring belt 5 changes, temperature control changeover timing optimum for the mode is effected, an effect similar to that of the present embodiment can be obtained.

Thus, again in a color image forming apparatus having a mode in which the paper transport interval changes, the temperature rise of the pressure roller 24 can be suppressed and therefore, it has become possible to prevent the occurrence of the offset phenomenon attributable to the toner T on the transferring material P being melted too much.

(Fourth Embodiment)

The color image forming apparatus is not restricted to one using an intermediate transferring body, but may be one having a construction which executes a plural-color image print mode in which a recording medium held by a recording medium supporting member is repetitively transported to image forming means portion to thereby successively form images of plural colors on the same recording medium, and a single-color image print mode in which the recording medium is transported once to thereby form an image of a single color.

Figure 11:
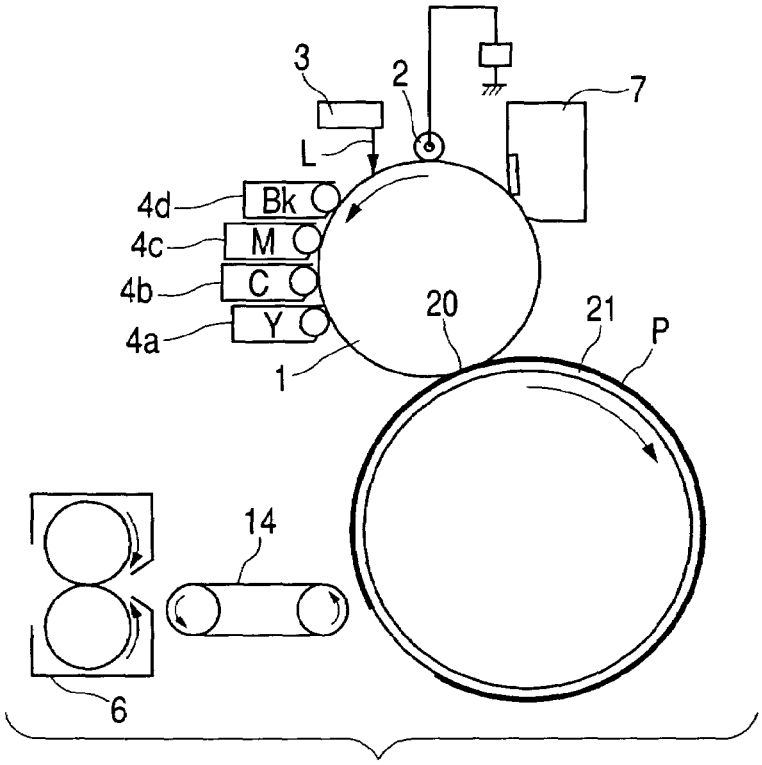
FIG. 11 shows an image forming apparatus according to a fourth embodiment of the present invention.

FIG. 11 is a schematic view of such a color image forming apparatus. In FIG. 11, the reference numeral 1 designates a photosensitive drum as an image bearing member, and it is rotatively driven in the direction of the associated arrow. The photosensitive drum 1, in its rotation process, is subjected to a uniform charging process by a charging roller 2, which is charging means, and laser beam scanning exposure L conforming to an image pattern by an exposure apparatus 3, whereby an electrostatic latent image is formed thereon. The electrostatic latent image is developed as a toner image by one of a plurality of color developing apparatuses of 4*a*(yellow), 4*b*(magenta), 4*c*(cyan) and 4*d*(black) The toner image is transferred to a transferring material P as a recording medium twined and held on a rotary transferring drum 21 as a recording medium supporting member in a transferring part 20. The surface of the photosensitive drum 1 after the transfer of the toner image to the transferring material P is cleaned by a cleaning apparatus 7 and is repetitively used for image forming.

The supply of the transferring material P to the transferring drum 21 is done from a sheet feeding portion (not shown) at predetermined control timing, and the holding of the transferring material P onto the transferring drum 21 may be accomplished by a check, electrostatic attraction or the like.

In the case of plural-color image print (full-color print), yellow, magenta, cyan and black toner images are successively formed on the photosensitive drum 1, and these toner images are successively transferred onto the same transferring material P held on the transferring drum 21, whereby a plural-color toner image is formed thereon. The transferring material P on which the plural-color toner image has been formed is separated from the rotary transferring drum 21, and is transported to a fixing apparatus 6 by a transporting belt 14, and the toner image is melted and fixed, whereby a color image print is obtained.

Also, in the case of single-color image print (monocolor print), a black toner image by the operation of the black color developing apparatus 4*d* is formed on the photosensitive drum 1, it is transferred onto a transferring material P held on the transferring drum 21, the transferring material P is separated from the rotary transferring drum 21 and is transported to the fixing apparatus 6 by the transporting belt 14, and the toner image is melted and fixed, whereby a monocolor print is obtained.

Again in such a color image forming apparatus, as in the first to third embodiments, the temperature rise of the pressure member can be suppressed by a control mode for changing the changeover timing of the control target temperature of the heating member during the single-color image print and during the plural-color image print, or changing the changeover timing of the control target temperature of the heating member of the fixing apparatus 6 during the single-color image print and during the plural-color image print and in conformity with the fixing speed, or changing the changeover timing of the control target temperature of the heating member of the fixing apparatus 6 during the single-color image print and during the plural-color image print and in conformity with the number of revolutions of the transferring drum 21 (and the photosensitive drum 1) as a recording medium supporting member, and therefore, it has become possible to prevent the occurrence of the phenomenon that the toner on the transferring material is melted too much and is offset to the heating member.

(Others)

1) The fixing apparatus is not restricted to the film fixing apparatus in the embodiments. It can be of a construction in which a heating body as a heater is caused to generate heat by electromagnetic induction heating or a heating member itself is caused to generate heat. In short, the fixing apparatus can be a fixing apparatus having a heating member and a pressure member and in which a transferring material or a recording medium is transported to a nip part constituted by the heating member and the pressure member to thereby fix an image.

2) The principle, process, system, etc. of image forming on an image bearing member and a recording medium are arbitrary.

3) In the first to third embodiments, the intermediate transferring body 5 can be of a rotary drum type. In the fourth embodiment, the recording medium supporting body 21 can be of a rotary belt type.

4) The exposure means 3 as information writing means is not restricted to the laser beam scanner in the embodiments, but may be other digital exposure apparatus such as a combination of a light source such as an LED array or a fluorescent lamp and a liquid crystal shutter, or may be an analog exposure apparatus for imaging and projecting an original image.

5) The image bearing member 1 may be an electrostatic recording dielectric. In this case, the surface of the dielectric is uniformly charged to a predetermined polarity and potential, whereafter the charges thereof are selectively eliminated by charge eliminating means (information writing means) such as a charge eliminating needle array or an electron gun to thereby write and form an electrostatic latent image conforming to image information. The image bearing member 1 may be a magnetic recording magnetic body.

6) The toner developing process and means for the electrostatic latent image, are arbitrary. Any of a reversal developing process and a regular developing process will do.

7) As the waveform of the AC component (AC voltage) of the bias applied to the charging means 2 and the developing apparatus 4, use can be suitably made of a sine wave, a rectangular wave, a triangular wave or the like. The AC bias includes, for example, a voltage of a rectangular wave formed by periodically switching on or off a DC voltage source.

8) The charging of the image bearing member may be done by so-called injection charging. In the case of charge injection charging, it is desirable that the image bearing member have a layer having surface resistance of $10^9$ Ω·cm to $10^{14}$ Ω·cm. For example, use can be made of one having as basic constituents a charge producing layer formed on the surface of a base, and a charge transporting layer formed on the surface of this charge producing layer. Specifically, use can be made of one having a charge injection charging property such as an OCL photosensitive member having an OPC photosensitive member coated with a surface layer (charge injecting layer) having electro-conductive particles such as $SnO_2$ dispersed therein, or a photosensitive member having a surface layer of α-Si (amorphous silicon)

What is claimed is:

1. A color image forming apparatus having a plural-color image print mode for successively forming images of plural colors, and a single-color image print mode for forming an image of a single color, and capable of forming, in the plural-color image print mode, a frame of a single-color image, and thereafter superimposing and forming an image of the next color on the single-color image, said color image forming apparatus comprising:

a fixing apparatus for fixing an image on a recording medium on which an image of plural colors or a single color has been formed; and a temperature controlling portion for controlling a temperature of said fixing apparatus so as to become a target temperature, wherein said fixing apparatus comprises a heating member and a pressure member and transports the recording medium to a nip part constituted by said heating member and said pressure member, and said temperature controlling portion, when printing of plural sheets is to be continuously effected, changes over the target temperature of said heating member when a predetermined number of sheets has been printed, and also changes the predetermined number of sheets for which the target temperature should be changed over, during single-color image printing and during plural-color image printing.

2. A color image forming apparatus according to claim 1, which successively forms images of plural colors on an image bearing member in the plural-color image print mode, and forms an image of a single color on said image bearing member in the single-color image print mode, and further comprises transferring means for transferring the images of plural colors or the image of a single color formed on said image bearing member onto the recording medium.

3. A color image forming apparatus according to claim 1, wherein in the plural-color image print mode, the recording medium held by a recording medium supporting member is repetitively transported to an image forming portion and images of plural colors are successively formed on the same recording medium, and in the single-color image print mode, the recording medium is transported once to the image forming portion and an image of a single color is formed thereon.

4. A color image forming apparatus according to claim 1, which has a plurality of fixing speeds, and changes the changeover timing of a control target temperature of said heating member during the single-color image print mode and during the plural-color image print mode and in conformity with the fixing speeds.

5. A color image forming apparatus according to claim 1, which has a plurality of modes which differ from one another in a number of revolutions of an image bearing member or a recording medium supporting member, and changes the changeover timing of a control target temperature of said heating member during the single-color image print mode and during the plural-color image print mode and in conformity with the number of revolutions of said image bearing member or said recording medium supporting member.

6. A color image forming apparatus according to claim 1, wherein said heating member comprises at least a film of a metal or resin and a heat generating member contacting with said film.

7. A color image forming apparatus having a plural-color image print mode for successively forming images of plural colors, and a single-color image print mode for forming an image of a single color, and capable of forming, in the plural-color image print mode, a frame of a single-color image, and thereafter superimposing and forming an image of the next color on the single-color image, said color image forming apparatus comprising:

a fixing apparatus for fixing an image on a recording medium on which an image of plural colors or a single color has been formed; and a temperature controlling portion for controlling a temperature of said fixing apparatus so as to become a target temperature, wherein said fixing apparatus comprises a heating member and a pressure member and transports the recording medium to a nip part constituted by said heating member and said pressure member, and said temperature controlling portion, when printing of plural sheets is to be continuously effected, lowers the target temperature of said heating member in the course of the continuous printing, and the lowered amount of the target temperature per number of continuously printed sheets during single-color image printing is less than the lowered amount of the target temperature per number of continuously printed sheets during plural-color image printing.

8. A color image forming apparatus according to claim 7, which successively forms images of plural colors on an image bearing member in the plural-color image print mode, and forms an image of a single color on said image bearing member in the single-color image print mode, and further comprises transferring means for transferring the images of plural colors or the image of a single color formed on said image bearing member onto the recording medium.

9. A color image forming apparatus according to claim 7, wherein in the plural-color image print mode, the recording medium held by a recording medium supporting member is repetitively transported to an image forming portion and images of plural colors are successively formed on the same recording medium, and in the single-color image print mode, the recording medium is transported once to the image forming portion and an image of a single color is formed thereon.

10. A color image forming apparatus according to claim 8, which has a plurality of fixing speeds, and wherein a lowered amount of a target temperature per number of continuously printed sheets at a first fixing speed is made greater than the lowered amount of the target temperature per number of continuously printed sheets at a second fixing speed.

* * * * *

UNITED STATES PATENT AND TRADEMARK OFFICE

CERTIFICATE OF CORRECTION

PATENT NO. : 6,999,692 B2
APPLICATION NO. : 10/669444
DATED : February 14, 2006
INVENTOR(S) : Masaru Shimura et al.

It is certified that error appears in the above-identified patent and that said Letters Patent is hereby corrected as shown below:

COLUMN 1
Line 30, “driven-in” should read --driven in--.

COLUMN 10
Line 49, “pmm” should read --ppm--.

COLUMN 15
Line 27, “silicon)” should read --silicon).--.

Signed and Sealed this

Twenty-fourth Day of July, 2007

JON W. DUDAS
*Director of the United States Patent and Trademark Office*